US011033137B2

(12) United States Patent
Geng

(10) Patent No.: US 11,033,137 B2
(45) **Date of Patent: *Jun. 15, 2021**

(54) SMART MAILBOX, SMART MAILBOX SYSTEM AND RELATED METHOD

(71) Applicant: Suzhou Dewo Smart System Co., Ltd., Kunshan (CN)

(72) Inventor: Xiaoju Geng, Nanjing (CN)

(73) Assignee: Suzhou Dewo Smart System Co., Ltd., Kunshan (CN)

( * ) Notice: Subject to any disclaimer, the term of this patent is extended or adjusted under 35 U.S.C. 154(b) by 67 days.

This patent is subject to a terminal disclaimer.

(21) Appl. No.: 16/401,774

(22) Filed: May 2, 2019

(65) Prior Publication Data

US 2019/0254460 A1 Aug. 22, 2019

Related U.S. Application Data

(63) Continuation of application No. 15/100,080, filed as application No. PCT/CN2014/091986 on Dec. 1, 2014, now Pat. No. 10,314,424.

(30) Foreign Application Priority Data

Nov. 30, 2013 (CN) ..... 201310632433.4

(51) Int. Cl.
*A47G 29/14* (2006.01)
*A47G 29/16* (2006.01)
*A47G 29/20* (2006.01)

(52) U.S. Cl.
CPC ..... *A47G 29/141* (2013.01); *A47G 29/16* (2013.01); *A47G 29/20* (2013.01);
(Continued)

(58) Field of Classification Search
CPC ..... A47G 29/141; A47G 29/16; A47G 29/20; A47G 2029/145; A47G 2029/146;
(Continued)

(56) References Cited

U.S. PATENT DOCUMENTS 5,774,053 A 6/1998 Porter
5,979,750 A 11/1999 Kindell
(Continued)

FOREIGN PATENT DOCUMENTS

CN 101194800 A 6/2008
CN 101437280 A 5/2009
(Continued)

OTHER PUBLICATIONS

Patent Examination Report filed in related Austrailian Patent Application No. 2014357022, dated Aug. 31, 2016; 5 pages.
(Continued)

*Primary Examiner* — William L Miller
(74) *Attorney, Agent, or Firm* — Sterne, Kessler, Goldstein & Fox P.L.L.C.

(57) ABSTRACT

A mailbox comprises a box body with a door having a lock, a mailbox unlocking code input device for inputting an unlocking code to unlock the mailbox, a communication module for communicating with a remote management terminal, a storage at the mailbox or the remote management terminal for storing one or more preset mailbox unlocking codes, and a processor at the mailbox or the remote management terminal for identifying whether the input mailbox unlocking code matches the one or more preset mailbox unlocking codes, and issuing a mailbox unlocking instruction if matching. The processor comprises a mailbox unlocking code management circuit used to invalidate the matched mailbox unlocking code after the mailbox is unlocked, generate a new mailbox unlocking code when no valid
(Continued)

mailbox unlocking code is currently available, and store the new mailbox unlocking code in the storage. The mailbox can safely, conveniently and automatically receive and/or send mail.

17 Claims, 11 Drawing Sheets

(52) U.S. Cl.
CPC .. *A47G 2029/145* (2013.01); *A47G 2029/146* (2013.01); *A47G 2029/148* (2013.01); *A47G 2029/149* (2013.01)

(58) Field of Classification Search
CPC ..... A47G 2029/148; A47G 2029/149; E05B 65/0075; G07C 9/00896; G07C 9/00912
USPC ..... 232/17, 19, 34–36, 45; 340/568.1, 569; 70/63
See application file for complete search history.

(56) References Cited

U.S. PATENT DOCUMENTS

| | | | | |
|---|---|---|---|---|
| 6,300,873 | B1 | 10/2001 | Kucharczyk et al. | |
| 7,191,932 | B2 | 3/2007 | Fobbe et al. | |
| 7,815,112 | B2 | 10/2010 | Volpe et al. | |
| 8,297,494 | B1 | 10/2012 | Davis et al. | |
| 8,358,195 | B2 | 1/2013 | Giles | |
| 8,358,199 | B2 | 1/2013 | Nesling | |
| 9,336,667 | B2 * | 5/2016 | Hammoud | A47G 29/141 |
| 10,292,519 | B1 * | 5/2019 | Sutton | A47G 29/1209 |
| 2001/0045449 | A1 | 11/2001 | Shannon | |
| 2001/0050615 | A1 | 12/2001 | Kucharczyk et al. | |
| 2002/0113703 | A1 | 8/2002 | Moskowitz et al. | |
| 2005/0104730 | A1 * | 5/2005 | Yang | A47G 29/141 340/569 |
| 2005/0253715 | A1 | 11/2005 | Awobue | |
| 2008/0278323 | A1 | 11/2008 | Jackson | |
| 2010/0019024 | A1 | 1/2010 | Wilms et al. | |
| 2015/0371468 | A1 * | 12/2015 | Mackin | G07F 17/12 340/5.26 |
| 2016/0140496 | A1 * | 5/2016 | Simms | B64C 39/024 705/337 |
| 2017/0251856 | A1 * | 9/2017 | Schaible | A47G 29/141 |
| 2018/0070753 | A1 * | 3/2018 | Eveloff | A47G 29/141 |
| 2019/0167025 | A1 * | 6/2019 | Cherry | A47G 29/16 |
| 2020/0138225 | A1 * | 5/2020 | Martin | B65D 55/02 |

FOREIGN PATENT DOCUMENTS

| | | | |
|---|---|---|---|
| CN | 102536042 | A | 7/2012 |
| CN | 202632357 | U | 12/2012 |
| CN | 102908034 | A | 2/2013 |
| CN | 102968826 | A | 3/2013 |
| CN | 102973116 | A | 3/2013 |
| CN | 202995834 | U | 6/2013 |
| CN | 103412497 | A | 11/2013 |
| CN | 103584701 | A | 2/2014 |
| CN | 203597763 | U | 5/2014 |
| WO | WO 2003/054778 | A1 | 7/2003 |
| WO | WO 2008/153269 | A1 | 12/2008 |

OTHER PUBLICATIONS

International Search and Written Opinion with English language translation directed to related PCT Application No. PCT/CN2014/091986, dated Mar. 6, 2015; 10 pages.

* cited by examiner

SMART MAILBOX, SMART MAILBOX SYSTEM AND RELATED METHOD

TECHNICAL FIELD

This invention refers to a smart mailbox and a smart mailbox system, for automatically receiving and/or sending a mail. This invention further refers to a related controlling method, a method of automatically receiving mail and a method of automatically sending a mail.

BACKGROUND

With the development of electronic commerce, people do more and more internet shopping. Internet shopping needs delivery, but the time the mail arrives at the receiving address is usually uncertain, or at least cannot be fixed in some short period. Therefore, there will be no sign or need to find someone else to sign for the receipt of delivery. This is often troublesome to the sender/courier, and also to the recipient; whatever, it's not pleasant to receive the mail earlier or have to ask other people to sign for it. Sometimes due to the security reasons, the sender/courier cannot get into high levels of a building, but has to wait for the recipient in the hall, while the recipient has to get down the stairs to fetch the mail and then get up, which is very inconvenient. Furthermore, people often have to receive the delivery at work even they have bought some household items, so that they have to move the goods home with additional cost. These are all unpleasant shopping experience.

The same problems could happen when there is a need to send a mail or return a purchased goods. The sender may have to go to work and cannot wait for the courier to pick up his mail; it's also troublesome to take the item be sent to the work.

This invention aims to solve the above-mentioned problems.

SUMMARY

This invention provides a smart mailbox and a corresponding smart mailbox system. This invention also provides a related controlling method, a method of automatically receiving mail and a method of automatically sending a mail. With this invention, it will be safe and convenient to automatically receive and/or send the mail, so that the troubles are saved. Furthermore, this invention provides intelligent monitoring, so that the mail can be safely handed over.

According to one aspect of this invention, it is provided a smart mailbox, which including a box body having a door with a lock; a box opening code input device for inputting box opening code so as to unlock the box and thus open it; and a communication unit for communicating with a remote management terminal; wherein the mailbox or the remote management terminal is also provided with a storage, for at least storing one or more preset box opening codes; the mailbox or the remote management terminal is provided with a processor, for identifying whether the input box opening code matches the one or more preset box opening codes, and being capable of issuing a box opening instruction; the processor comprises a box opening code management circuit, for invalidating the matched box opening code after opening the box, and generating new box opening code(s) when there is no valid box opening code, and the processor is capable of storing the new box opening code(s) in the storage.

According to another aspect of this invention, it is provided a smart mailbox system, which including a mailbox and a remote management terminal, wherein the mailbox comprises a box body having a door with a lock; the mailbox is provided with a box opening code input device for inputting box opening code so as to unlock the box and thus open it; the mailbox is further provided with a communication unit for communicating with a remote management terminal; the mailbox and/or the remote management terminal is provided with a storage, for at least storing one or more preset box opening codes; the mailbox and/or the remote management terminal is further provided with a processor for identifying whether the input box opening code matches the one or more preset box opening codes, and being capable of issuing a box opening instruction; the processor comprises a box opening code management circuit, for invalidating the matched box opening code after opening the box and generating new box opening code(s) when there is no valid box opening code, and the processor is capable of storing the new box opening code(s) in the storage.

The smart mailbox and the smart mailbox system of this invention respectively includes the following one or more optional features:

The smart mailbox further includes at least one inner camera, for at least monitoring the circumstance inside the box body from the door opening to the door closure;

The smart mailbox further includes at least one outer camera, for at least monitoring the circumstance around the box body before the box opening;

The at least one outer camera includes at least one front camera;

The processor analyzes the circumstance around the box body before the box opening which is recorded by the at least one outer camera, activates the box opening code input device after confirming there is nothing unusual, so as to allow the input of the box opening code;

The processor activates the inner camera after issuing the box opening instruction;

The record of the at least one inner camera is stored in the storage;

The record of the at least one outer camera is stored in the storage;

The smart mailbox further includes a first display in the front of the box body, for at least providing operating tips to the mailbox user;

The smart mailbox further includes a second display located in the box body, at the back of the door, for at least providing operating tips to the mailbox user after the door opening;

The smart mailbox further includes an alarm device, for alarming at an abnormal situation; and the alarm information is also sent to the remote management terminal via the communication unit;

The alarm device can be activated or turned off by the mailbox administrator;

The smart mailbox further includes a vibration sensor, for detecting the vibration of the mailbox;

The smart mailbox further includes a gravimetric sensor, for detecting the weight of the item(s) inside the mailbox;

The smart mailbox further includes an altimetric sensor, for determining the height of the smart mailbox;

The smart mailbox further includes an alarm device, which alarms when the vibration sensor detects an abnormal box opening or an abnormal box detachment;

The smart mailbox further includes an alarm device, which alarms when the gravimetric sensor detects an abnormal change of the weight of the item(s) inside the box;

The smart mailbox further includes an alarm device, which alarms when the altimetric sensor detects an abnormal height variation of the mailbox;

The smart mailbox further includes an inner power source inside an inner power source box;

The smart mailbox further includes an external power supply;

The smart mailbox further includes an alarm device, which alarms when the external power supply is cut off;

The smart mailbox further includes an alarm device, which alarms when the inner power source is in a low battery status;

The inner power source box has a cover with an electronic lock;

The cover can be opened from outside the mailbox;

The electronic lock can be unlocked by inputting a cover opening code via the box opening code input device;

The smart mailbox further includes an alarm device, which alarms if the inner power source is taken away without previous authorization;

The smart mailbox further includes an ID code scanner;

The ID code scanner includes a barcode scanner and/or a matrix code scanner;

The storage also stores one or more preset ID codes; only after the ID code scanner scans a matched ID code and the input box opening code matches one or more preset box opening codes, the processor issues the box opening instruction;

The one or more preset ID codes have a mapping relationship with the one or more preset box opening codes; the processor only issues the box opening instruction when the matched box opening code maps the matched ID code;

The box opening code input device is activated only after the ID code scanner scans the matched ID code;

The ID code scanner is activated only after the input box opening code matches one or more preset box opening codes;

The box opening code input device has the function to choose the user group;

The box opening code(s) maps with the user group(s).

According to one aspect of this invention, it is provided a method for controlling a smart mailbox system, which comprises a mailbox and a remote management terminal, wherein the mailbox comprises a box body having a door with a lock, the mailbox is provided with a box opening code input device and a communication unit, the mailbox and/or the remote management terminal is provided with a storage, and the mailbox and/or the remote management terminal is further provided with a processor; the method includes the following steps: receiving the input box opening code via the box opening code input device; determining whether the input box opening code matches the previously stored one or more preset box opening codes; if matches, issuing a box opening instruction so as to unlock the box, and invalidating the matched box opening code; and determining whether there is any valid box opening code, and generating new box opening code(s) if not.

According to yet another aspect of this invention, it is provided a method of automatically receiving mail using a smart mailbox system, which comprises a mailbox and a remote management terminal, wherein the mailbox comprises a box body having a door with a lock, the mailbox is provided with a box opening code input device and a communication unit, the mailbox and/or the remote management terminal is provided with a storage, and the mailbox and/or the remote management terminal is further provided with a processor; the method includes the following steps: the sender/courier obtains a box opening code from the recipient; the sender/courier inputs the obtained box opening code via the box opening code input device; the processor determines whether the input box opening code matches the previously stored one or more preset box opening codes; if matches, the processor issues a box opening instruction so as to unlock the door for opening the box; the sender/courier puts the mail into the mailbox, and closes the door; wherein after the processor issues the box opening instruction to open the door, or the sender/courier closes the door, the processor invalidates the matched box opening code; and the processor determines whether there is any valid box opening code, and generates new box opening code(s) if not.

According to a further aspect of this invention, it is provided a method of automatically sending a mail using a smart mailbox system, which comprises a mailbox and a remote management terminal, wherein the mailbox comprises a box body having a door with a lock, the mailbox is provided with a box opening code input device and a communication unit, the mailbox and/or the remote management terminal is provided with a storage, the mailbox and/or the remote management terminal is further provided with a processor; the method includes the following steps: the sender puts the mail into the mailbox, and closes it; the recipient/courier obtains the box opening code from the sender; the recipient/courier inputs the obtained box opening code via the box opening code input device; the processor determines whether the input box opening code matches the previously stored one or more preset box opening codes; if matches, the processor issues a box opening instruction so as to unlock the door for opening the box; the recipient/courier takes the mail out, and closes the box; wherein after the processor issues the box opening instruction to open the box, or after the recipient/courier closes the mailbox, the processor invalidates the matched box opening code; and the processor determines whether there is any valid box opening code, and generating new box opening code(s) if not.

The method for controlling a smart mailbox system, the method of automatically receiving mail using a smart mailbox system and the method of automatically sending a mail using a smart mailbox system in this invention further respectively includes the one or more optional features:

In the mailbox it is provided an ID code scanner for scanning the ID code of the mailbox user and/or the mail;

The information of the one or more preset ID codes is previously stored in the storage; only after the scanned ID code matches the preset ID code, and the input box opening code matches the preset box opening code, the processor issues the box opening instruction;

The one or more preset ID codes have a mapping relationship with the one or more preset box opening codes; the processor issues the box opening instruction only after confirming the matched box opening code maps matched ID code;

Only after the scanned ID code matches the preset ID code, the box opening code input device is activated;

Only after the input box opening code matches the preset box opening code, the ID code scanner is activated;

In the mailbox it is further provided at least one outer camera, for at least monitoring the circumstance around the box body before opening the box;

The processor analyzes the circumstance around the box body before the box opening which is recorded by the at least one outer camera; and after confirming there is nothing unusual, the processor issues the box opening instruction;

The processor analyzes the circumstance around the box body before the box opening which is recorded by the at least one outer camera; and after obtaining a clear face characteristics of the mailbox user, the processor issues the box opening instruction;

In the mailbox it is further provided at least one inner camera, for at least monitoring the circumstance inside the box body from the box opening to the box closure;

After the processor issues the box opening instruction, the at least one inner camera is activated;

The record of the at least one outer camera is stored in the storage;

The record of the at least one inner camera is stored in the storage;

After the door is closed, the processor gives out a confirmation message/mail receipt confirmation message/mail taken confirmation message;

The processor analyzes the record of the at least one inner camera, and gives out the confirmation message only after confirming there is nothing unusual;

On the mailbox it is provided at least one outer display, for at least displaying tips for operating the mailbox;

In the mailbox it is provided at least one inner display, for at least displaying tips for operating the mailbox after the box opening;

Only after the processor issues the box opening instruction, the at least one inner display is activated;

In the mailbox it is further provided an alarm device, for alarming in an abnormal situation;

The alarming information is also sent to the remote management terminal via the communication unit;

The alarm device can be activated or turned off by the mailbox administrator;

In the mailbox it is further provided a vibration sensor, for detecting the vibration of the mailbox;

In the mailbox it is further provided a gravimetric sensor, for detecting the weight of the items inside the mailbox;

In the mailbox it is further provided an altimetric sensor, for detecting the height of the mailbox;

When the vibration sensor detects an abnormal box opening or an abnormal box detachment, it alarms;

When the gravimetric sensor detects an abnormal change of the weight of the item(s) inside the box, it alarms;

When the altimetric sensor detects an abnormal height variation of the mailbox, it alarms;

In the mailbox it is further provided an inner power source, and the battery status of the inner power source is monitored;

On the mailbox it is further provided an external power supply, and the on/off status of the external power supply is monitored;

When the inner power source is in low battery, it alarms;

When the external power supply is cut off, it alarms;

Determining whether there is an authorization before detaching the inner power source, if not then it alarms;

The processor gives out the confirmation message only after confirming that there is no alarm;

The user group is input before inputting the box opening code via the box opening code input device;

The box opening code(s) has a mapping relationship with the user group(s);

In the mailbox it is provided an ID code scanner, for scanning the ID code of the sender/courier and/or the mail;

After the mailbox is closed, the processor gives out a mail receipt confirmation;

The processor analyzes the record of the at least one inner camera, and gives out the mail receipt confirmation only after confirming the outer packing of the mail is in good condition;

The processor gives out the mail receipt confirmation only after confirming that there is no alarm;

After the processor gives out the mail receipt confirmation, it sends an acknowledgment of the receipt to the sender;

After the recipient gets the mail receipt confirmation or gets the mail, an acknowledgment of the receipt is sent to the sender;

The recipient is the mailbox manager, and can obtain the box opening code from the smart mailbox system;

The recipient is not the mailbox administrator, and can obtain the box opening code from the mailbox administrator;

The mailbox administrator can open the mailbox by using the management authority, without using the box opening code;

After the mailbox administrator opens the mailbox or closes it, the processor generates new box opening code(s);

The sender/courier chooses his/her user group before inputting the obtained box opening code via the box opening code input device;

The recipient/courier also inputs his/her ID information before opening the box;

Only after the processor confirms the recipient/courier's ID information is correct, it issues the box opening instruction;

The recipient/courier takes the mail out after confirming that the mail fetching requirements are satisfied, and then closes the door;

The recipient/courier confirms whether the mail fetching requirements are satisfied under the record of the at least one inner camera;

The processor gives out the mail taken confirmation only after confirming that there is no alarm;

After the recipient/courier takes the mail out and closes the mailbox, the processor gives out a mail taken confirmation;

After the recipient/courier takes the mail out and closes the mailbox, an acknowledgment that the mail has been taken out is sent to the sender;

The sender is the mailbox administrator, and can obtain the box opening code from the mailbox administrator;

The sender is not the mailbox administrator, and can obtain the box opening code from the mailbox administrator;

The recipient/courier chooses his/her user group before inputting the obtained box opening code via the box opening code input device.

The advantages of this invention lie in that, as along as the sender/courier delivers the goods to the designated address, the receiving step can be done safely and conveniently regardless the presence of the recipient, and the sender can also finish the sending step safely and conveniently regardless the presence of the recipient/courier.

DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention. Wherein FIG. 1 illustratively shows one embodiment of the smart mailbox according to this invention;

FIG. 1*a* illustratively shows another embodiment of the smart mailbox according to this invention, wherein the mailbox comprises a display;

FIG. 2 illustratively shows another embodiment of the smart mailbox according to this invention, wherein the mailbox comprises an outer camera;

FIG. 3 illustratively shows yet another embodiment of the smart mailbox according to this invention, wherein the mailbox comprises an inner camera;

FIG. 4 illustratively shows yet another embodiment of the smart mailbox according to this invention, wherein the mailbox comprises an ID code scanner;

FIG. 5 illustratively shows yet another embodiment of the smart mailbox according to this invention, wherein the mailbox comprises a loudspeaker;

FIG. 6 illustratively shows yet another embodiment of the smart mailbox according to this invention, wherein the mailbox comprises an inner power source;

FIG. 7 shows one preferable embodiment of the smart mailbox according to this invention;

FIG. 7*a* shows another preferable embodiment of the smart mailbox according to this invention;

FIG. 8 illustratively shows one embodiment of the smart mailbox system according to this invention;

FIG. 9 illustratively shows the circuit logic of one embodiment of the smart mailbox system according to this invention;

Figure 11:
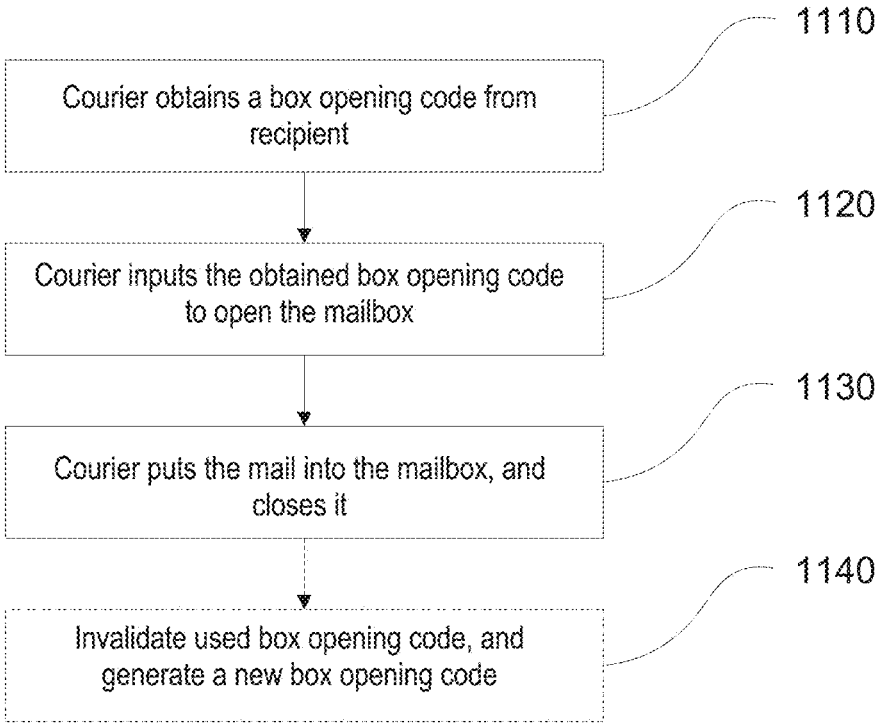
FIG. 11 shows the method of automatically receiving mail according to one embodiment of this invention.
Figure 11A:
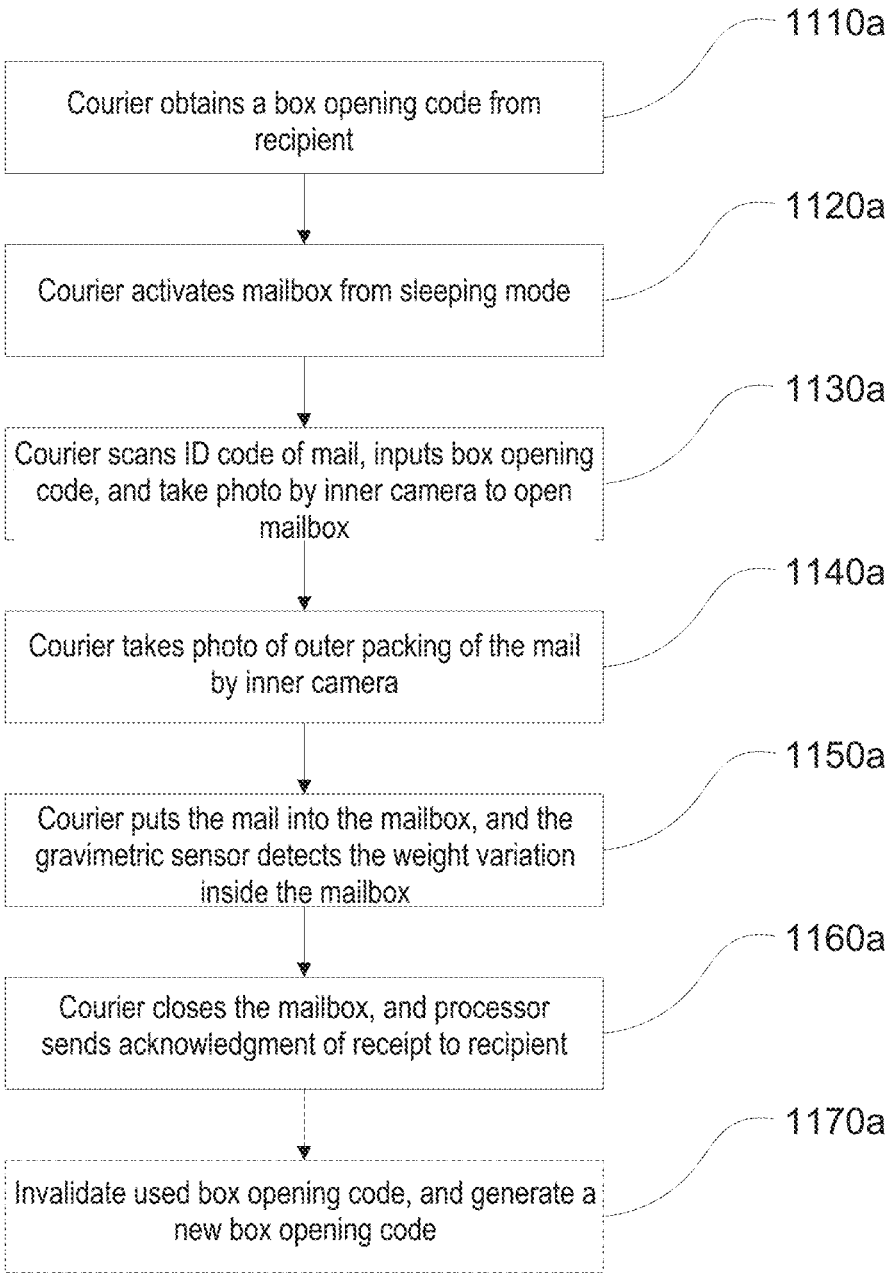
Figure 12:
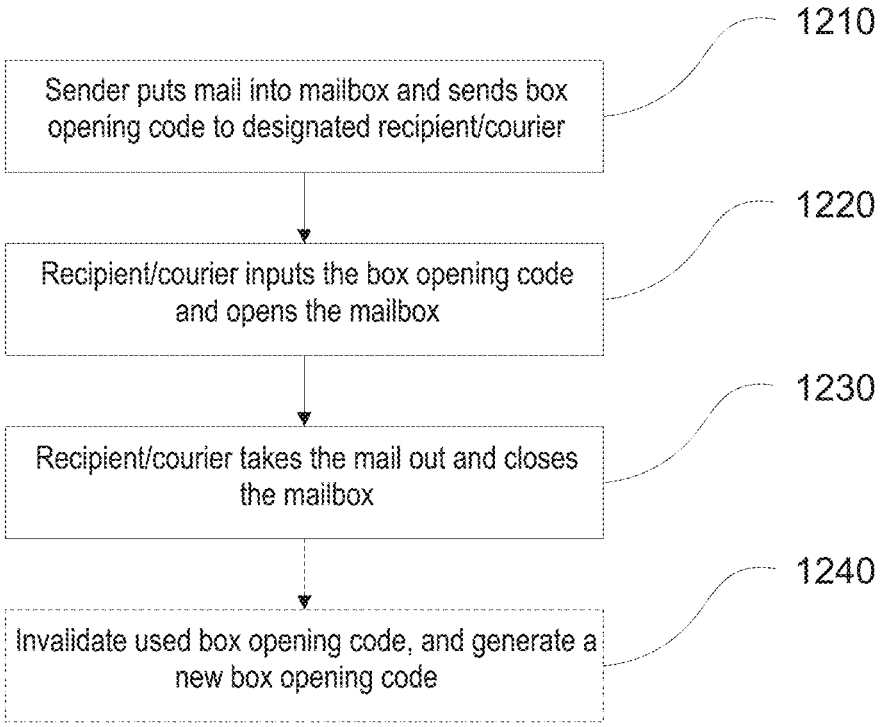
Figure 12A:
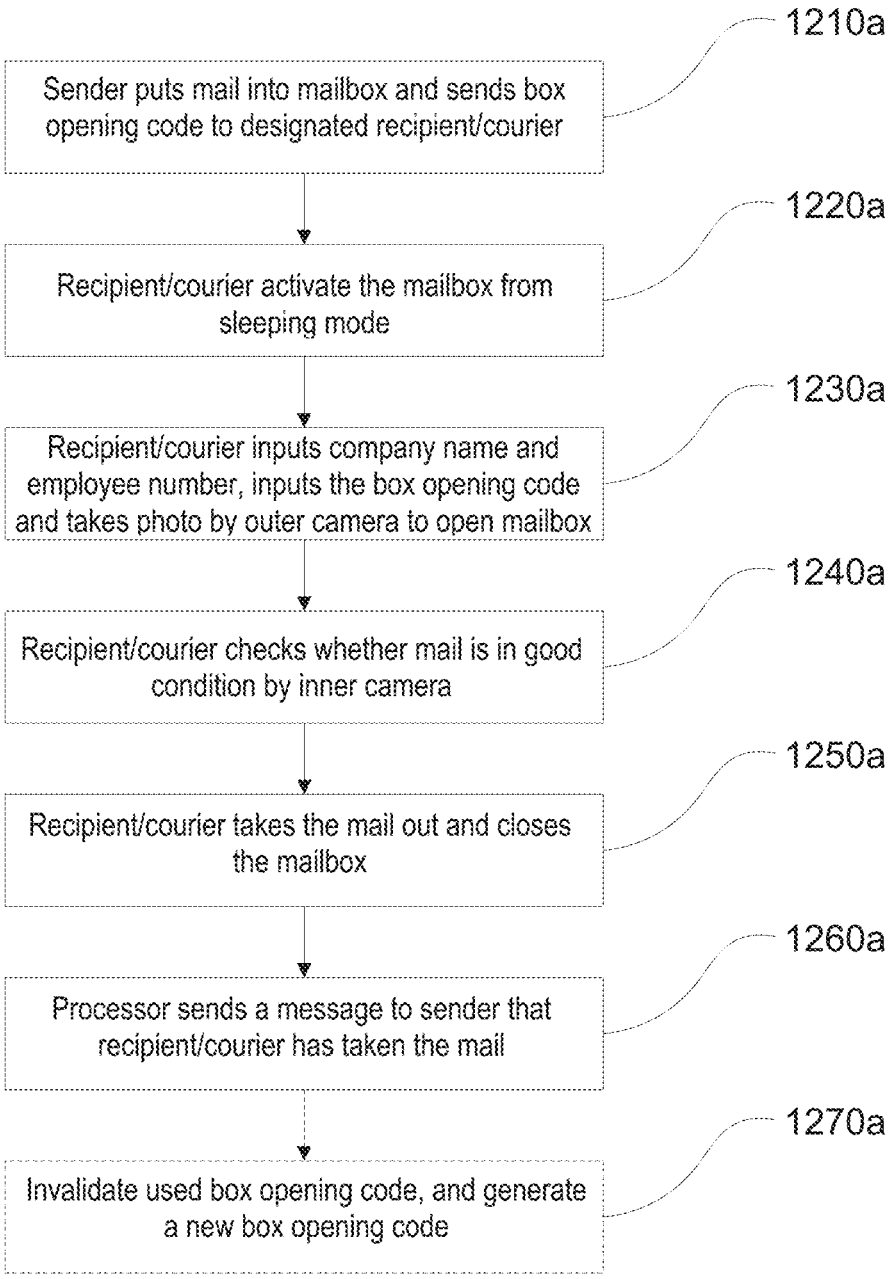

FIG. 11*a* shows the method of automatically receiving mail according to one preferable embodiment of this invention;

FIG. 12 shows the method of automatically sending a mail according to one embodiment of this invention;

FIG. 12*a* shows the method of automatically sending a mail according to one preferable embodiment of this invention.

EMBODIMENTS

Before explaining at least one embodiment of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiment incorporating aspects of the present inventions will require numerous implementation-specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the Figures and are not intended to limit the scope of the invention or the appended claims. Further, it should be understood that any one of the features of the invention may be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

Reference will now be made in detail to an implementation consistent with the present invention as illustrated in the accompanying drawings.

Figure 1:
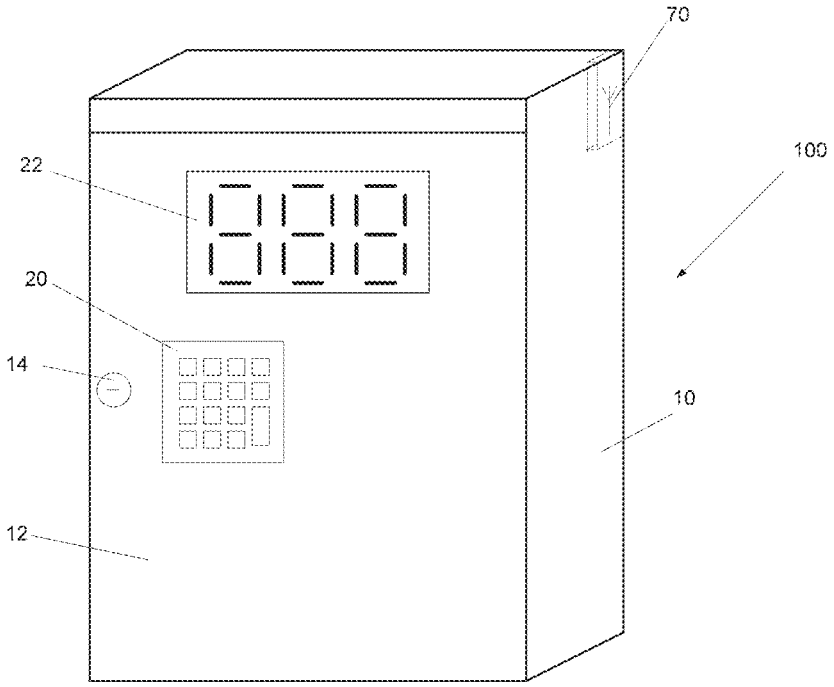

FIG. 1 illustratively shows one embodiment of the smart mailbox according to this invention.

As shown in the figure, the mailbox 100 comprises a box body 10, the front of which is provided with a door 12; a lock 14 is arranged on the left part of the door 12, while a keyboard 20 for inputting the box opening code is arranged at the right side of the lock 14. The keyboard comprises number keys "0-9", and the keys of "backspace", "cancel" and "OK". Above the keyboard 20 it is provided a LED display 22. It should be noted that, the position of these parts on the mailbox can be adjusted according to the actual needs; for example, the door could also be arranged atop or aside the box body, the lock could also be arranged at the right of the door, while the keyboard and the LED display could be arranged in any position convenient for the user's operation; the LED display could be arranged in any position convenient for the user to check the information. Furthermore, the keyboard and/or LED display do not have to be arranged on the door, for example, when the door does not occupy the whole front part of the box body, the keyboard and/or the LED display could be arranged on other parts of the face.

In some embodiments, one more LED display could be attached in the inner side of the door.

In some other embodiments, the keyboard could also comprises other keys. For example, the keyboard could comprise the directions keys like "up", "down", "left" and "right"; the keyboard could also comprises alphabetic keys. Moreover, the keyboard could also comprises user group selection keys, such as "sender/courier log in", "recipient/courier log in" and "administrator log in".

Apart from for inputting the box opening code, the keyboard could also be used for inputting other identification information, for example, the identification information of the mail (e.g. mail number) or the identification information of the postman (such as company name, employee number).

The LED display could be used to give tips about the information necessary for log in, and also give feedback to the user. The LED display could also display the information which the mailbox owner or administrator wants to display.

The mailbox 100 further has a communication unit (not shown), which is arranged inside the mailbox in an invisible manner when viewing from the outside. However, the communication unit could comprise antenna. As shown in the figure, an antenna 70 is arranged inside the mailbox 100, at the joint of the right part and the back plate, for communicating with a remote management terminal. It should be noted that, the communication unit could use the common mobile communication network (such as networks of 2G/3G/4G), or wireless protocols like WIFI or bluetooth. It should also be noted that, the form, size, quantity and position of the antenna are adjustable according to the actual needs; for example, it could use an external antenna, a longer antenna, or a dual-antenna, or the antenna could also be arranged at the joint of the left part and the back plate.

Figure 1A:
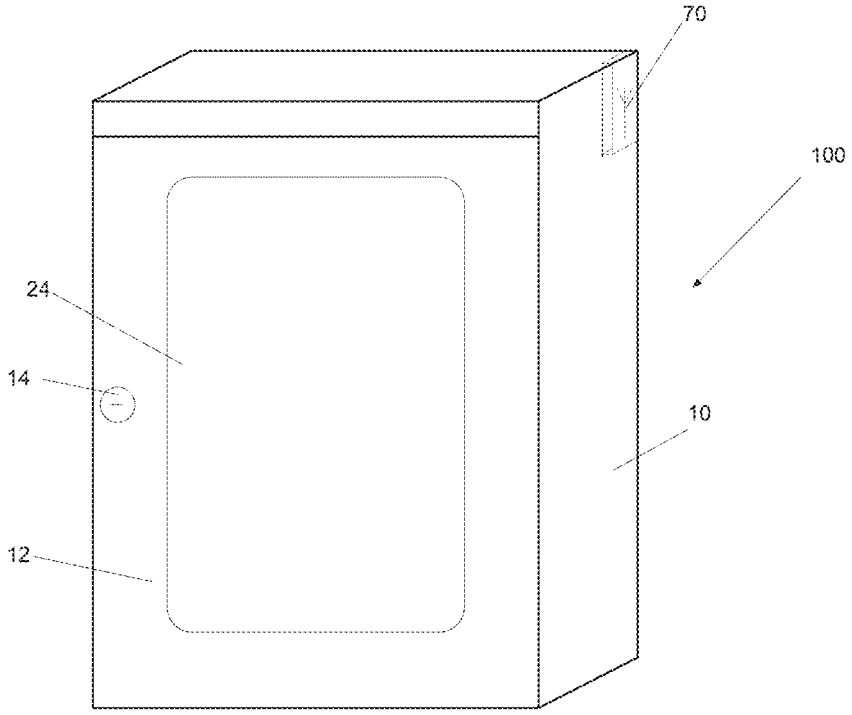

FIG. 1*a* illustratively shows another embodiment of the smart mailbox according to this invention, wherein the keyboard and the LED display in the front of the mailbox are replaced by a touch panel 24. The touch panel 24 will have virtual keys as the physical keys of the keyboard. The touch panel 24 could be any commercial resistive or captive panel, e.g. the IPS. In some embodiments, when in the inner side of the door it is also arranged a LED display, this LED display could also be replaced by a touch panel.

Obviously, the touch panel and the LED display could be collectively called as a display when referring to the visual output, while when referring to the box opening code input, the touch panel and the keyboard could be collectively called as the box opening code input device.

Figure 2:
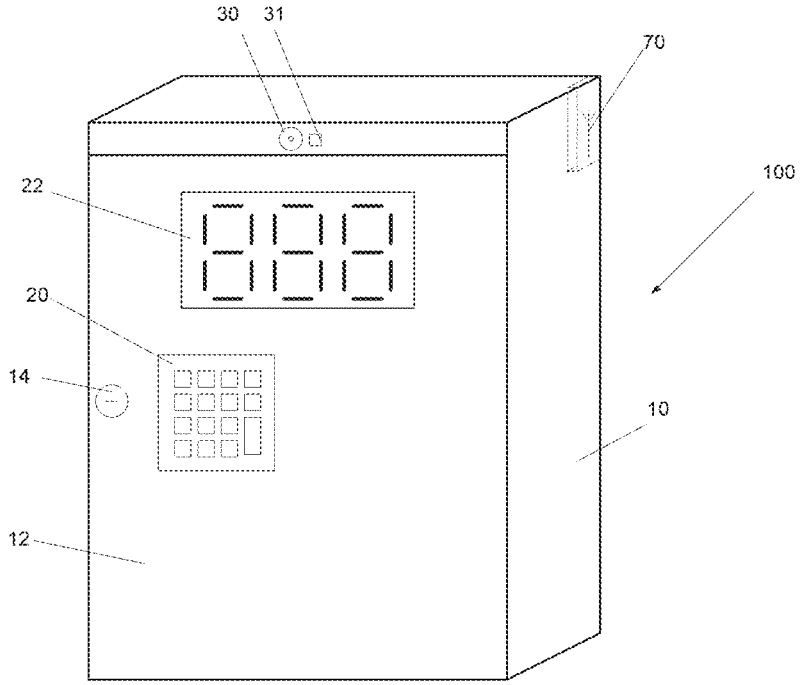

FIG. 2 illustratively shows another embodiment of the smart mailbox according to this invention, wherein the mailbox 100 comprises an outer camera 30. As shown in the figure, in the upper front of the mailbox 100, it is arranged a front camera 30. The front camera could be a commercial camera, like those with 500M pixels. Aside the front camera 30 is arranged a LED flash 31. The front camera is configured to monitor at least the situation in front of the mailbox, especially to monitor whether a box user is an appropriate one.

It should be noted that, the parameters of the front camera, like the position, quantity and the pixels are adjustable based on the actual needs. When necessary, the mailbox could also include other outer cameras to monitor the situation around the mailbox.

Figure 3:
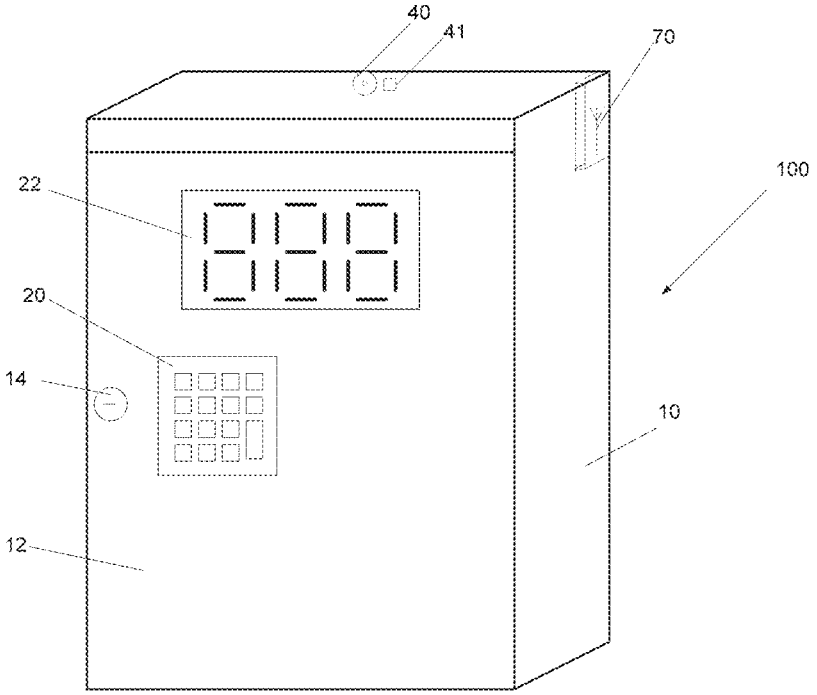

FIG. 3 illustratively shows yet another embodiment of the smart mailbox according to this invention, wherein the mailbox 100 comprises inner camera 40. As shown in the figure, an inner camera 40 is arranged inside the mailbox at the upper part of the back plate. The inner camera could also be a commercial camera, like those with 500M pixels. Aside the inner camera 40 is arranged a LED flash 41. The inner camera is configured to monitor the items inside the box body, for example, the increase or decrease of the items, the outer packing of the items, the unpacking process of items, etc., for the safe receipt of the mail. For example, the inner camera could be used to take pictures or video of the mail, for confirming a safe receipt when the outer packing is in good condition, or take real time photos or video that the courier unpacks on the spot, for confirming a safe receipt when the goods is in good condition. Whether to confirm a safe receipt could be either determined by the processor automatically, or by the recipient via remote interaction. After confirming a safe receipt, an acknowledgment of receipt could be sent by the processor or the recipient and fed back to the courier. As such, in the case of sending a mail, the inner camera could also be used to help the courier to confirm a safe receipt. If the goods is defective, the courier could prove that it's not because of his fault with the record of the inner camera.

It should be noted that, the parameters of the inner camera, such as position, quantity, pixels are also could adjustable based on the actual needs.

Figure 4:
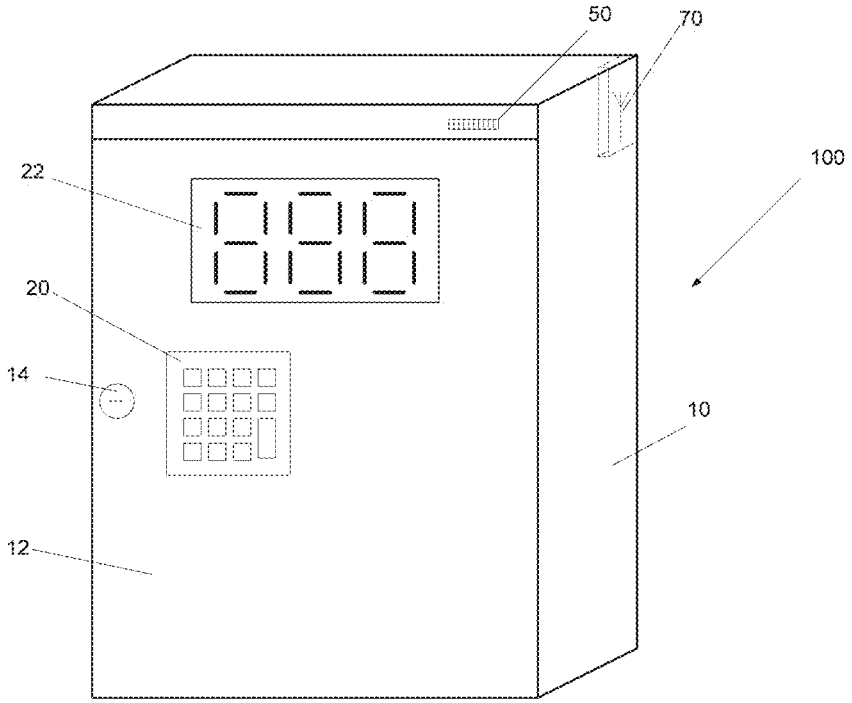

FIG. 4 illustratively shows yet another embodiment of the smart mailbox according to this invention, wherein the mailbox 100 comprises an ID code scanner 50. As shown in the figure, in the front of the mailbox 100 it is arranged a code reader 50, which could be used to read various identification code, such as the barcode or matrix code on the mail. It should be noted that, the position of the code reader is adjustable based on the actual needs; for example, it could be arranged aside the keyboard or aside the front camera, and it does not have to be arranged on the front part of the mailbox, but on the side part or the bottom part. A switch button or activate/sleep button could be assigned to the code reader (not shown). This button could be arranged in the keyboard.

The code reader could be cooperate with the keyboard. It could be configured that only when the code reader reads a correct code and the input box opening code is also correct, the box can be opened. In some embodiments, a mapping relationship could be set among the correct identification code and the correct box opening code. For example, the box opening code assigned to mail A which is expected to be received is 1234, while identification code of mail A is pattern AAA; the box opening code assigned to mail B which is also expected to be received is 5678, while the identification code of mail B is pattern BBB, then the box opening code 1234 maps with the pattern AAA, while the box opening code 5678 maps with pattern BBB. In such a case, it could also be configured that the mailbox can be opened only when not only the read code and the input codes are correct, but also they maps with each other.

Figure 5:
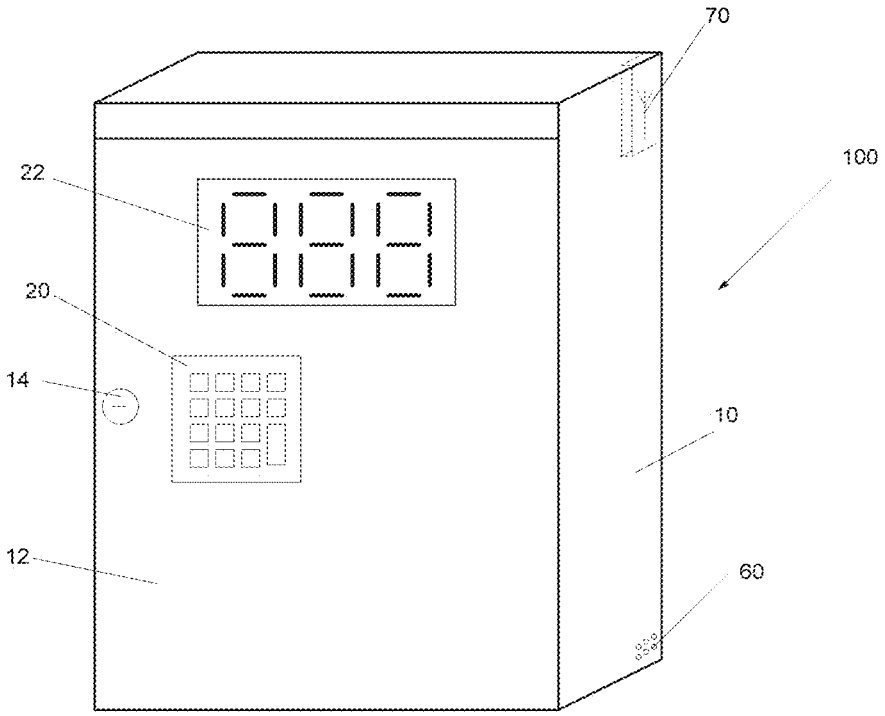

FIG. 5 illustratively shows yet another embodiment of the smart mailbox according to this invention, wherein the mailbox 100 comprises a loudspeaker. As shown in the figure, in the side part of the mailbox 100 it is arranged some sound holes 60, and inside the mailbox where it corresponds to the sound holes 60 it is arranged a loudspeaker (not shown). The loudspeaker could be used to provide acoustic tips for the users. The acoustic tips could cooperates with the visual tips of the display. It should be noted that, the positions of the loudspeaker and the sound holes are adjustable based on the actual needs; for example, they could be arranged in a position near the top part, or in a position near the bottom part; they could also be arranged in the front part, the back part or the bottom part of the box body in some embodiments.

In some embodiments, on the box body it could also be arranged a microphone and corresponding sound holes. The microphone could be used as the acoustic input.

Figure 6:
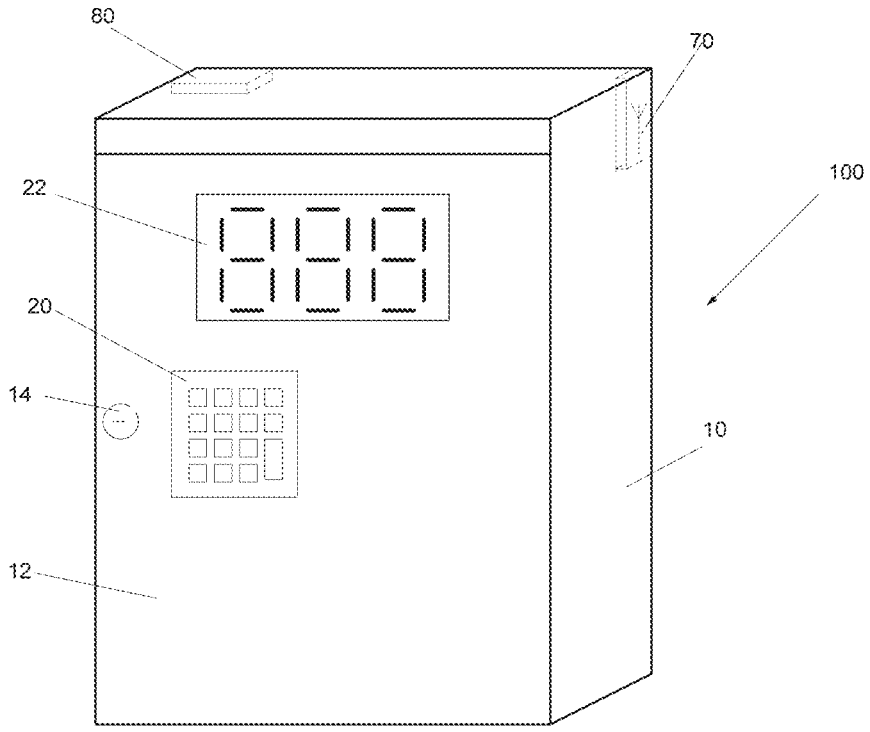

FIG. 6 illustratively shows yet another embodiment of the smart mailbox according to this invention, wherein the mailbox 100 comprises inner power source. As shown in the figure, inside the mailbox it is further arranged an inner power source, which is positioned on the top plate and received in an inner power source box 80. The inner power source could be a rechargeable and/or replaceable battery. The battery is usually invisible viewing from outside, but could be accessed by opening the cover of the inner power source box. The cover of the box is arranged inside the mailbox; however, it could also be arranged on the outer surface of the mailbox, then changing the battery without opening the box is possible. The cover of the inner power source box is configured to be opened only when there is an authorization, such as by means of an electronic lock. The electronic lock could also be unlocked by inputting the password by the keyboard/virtual keyboard.

In some embodiments, it could also be alternatively or additionally arranged an external power supply, such as a plug. In the case there are both inner and outer power supplies, the external power supply could be used to charge the inner power source.

In some embodiments, for saving the energy, all components of the mailbox or a portion of them could be set into sleeping mode if some requirements are met such as no operation in a certain period. For example, after the mailbox has been closed for a certain period, the mailbox could get into sleeping mode.

Once there is an operation, the whole mailbox is activated or the corresponding component(s) is activated. For example, once keyboard (or touch panel) senses a pressure action, then it is activated, and preferably the LED display is activated in the meantime. For example, once the keyboard (or touch panel) senses a pressure action, the front camera (or other outer camera) is also activated in the meantime. For example, when the mailbox door is opened to a certain angle, like 120°, the inner LED display (or touch panel) is activated; in another example, when the inner LED display (or touch panel) is activated, the outer LED display (or touch panel) is turned off; in yet another example, when the mailbox door is closed, the inner LED display (or touch panel) sleeps. For example, the inner camera is activated only when the door is opened, and it sleeps when the door is closed. In another example, the code reader is activated only when the input box opening code is correct, or the keyboard (or touch panel) is activated only when the code reader reads a correct code.

It should be noted that, the activated and sleeping modes could be implemented at a preset time, and could also be controlled by the remote management terminal. In some embodiments, the outer camera could be configured to be always in activated mode, to be used as a monitor.

Inside the mailbox it could also be arranged an alarm in an invisible manner when viewing from outside. The alarm could be used for alarming in an abnormal situation. It could be assigned with a buzzer, which could be arranged in the mailbox in a position corresponding to the sound holes, for giving out a sound alarm; the sound alarm could be given out by means of the loudspeaker in the case there is one. The alarm information could also be sent to the remote management terminal by the communication unit. The alarming could be sending a waning message to the mailbox administrator; it does not have to be an unpleasant sound alarm. The alarm is configured to be turned on or off by the mailbox administrator.

In the mailbox there could further be some sensors which are invisible when viewing from outside; these sensors could be used to cooperate with the alarm.

For example, in the mailbox there could be arranged a vibration sensor, when it detects an abnormal box opening or an abnormal detachment (usually a violent one), it triggers the alarm.

In another example, in the mailbox there could be arranged a gravimetric sensor, for detecting the weight of the items inside the mailbox. When the gravimetric sensor detects an abnormal change of the weight of the item(s) inside the box, it triggers the alarm. The abnormal change of the weight could be that the actual change does not correspond to the expected change; for example, when the gross weight of the expected mail is about 300 g, while the addition of the weight of the items inside the box is only 200 g, this might mean the received mail is not the expected mail; furthermore, when there is no expected mail taken out action but the weight reduces, this might mean there is an unauthorized taken out. It could be configured that the gravimetric sensor only triggers the alarm when it detects an unexpected weight variation (like weight reduction) inside the mailbox and the unexpected variation does not recover to an expected variation for a certain period; for example, if there is other items in the mailbox, the courier will have to take some items and may be adjust their positions to find a pace for the new mail.

In yet another example, in the mailbox there could also be arranged an altimetric sensor for detecting the height of the mailbox. When the altimetric sensor detects an abnormal height variation of the mailbox, it triggers the alarm, because this might mean that the mailbox is taken away in whole, or falls from a height (if it is hang on a wall).

Besides the sensors, other components could also be used to cooperate with the alarm, separately or in combination. For example, the alarm could use the photos taken by a camera, such as the outer camera (especially the front camera) and/or the inner camera to determine whether it should alarm; for example, if the camera observes an item inside the mailbox is taken away while there is no expected mail taken out action, it alarms. In another example, it could alarm when the inner power source face a low battery; it could also alarm when the external power supply is cut off. In yet another example, when the inner power source box is opened without an authorization, it alarms.

It could be configured that the mailbox does not alarm according to the alarm triggering information from only one component, but make the alarm decision based on the information from several sources. For example, when a gravimetric sensor is used to judge whether there is an unexpected weight reduction, the record of a camera could be combined therewith for the processor to determine whether there is a mail taken out without authorization.

The alarm could be configured to cooperate with the power management. For example, when the cameras are in sleep but other component(s) triggers the alarm, the outer camera (especially the front camera) and/or the inner camera is activated immediately, and takes photos or video of the person who causes the alarm; preferably the photos or video is sent to the remote management terminal in real time for storage, and the mailbox administrator is informed in time.

It should be noted that, the alarm circuit could be implemented as a separate module, or integrated in the processor.

In the mailbox a storage could be arranged in an invisible manner when viewing from outside. The storage are used for storing data, such as the data input from the keyboard, the data taken by the cameras and the data detected by the sensors. For example, the storage could previously store one or more preset box opening codes. The box opening code could be preset based on the information of the items to be received. When there are more than one item to be received, it could preset more than one box opening code. In another example, the storage could previously store one or more preset identification code regarding the mail(s) to be received.

In the mailbox a processor could also be arranged in an invisible manner when viewing from outside. The processor could control other components, analyze the data and make the determination; for example, it determines whether the input box opening code is correct, whether the item put into the in the mailbox satisfy the safe receipt conditions, whether the power is sufficient, and so on. For example, when a box opening code is input by the keyboard, the processor confirms the input box opening code matches the preset box opening code, the mailbox is opened.

The processor could comprise a box opening code management circuit, for invalidating the used box opening code, and generating new box opening code(s) when there is no valid box opening code; the new box opening code(s) is stored in the storage as the preset box opening code(s). When there is only one preset box opening code, the processor generates new box opening code(s) upon invalidating it; when there are several preset box opening codes, the processor invalidates the used one and generates new box opening code(s) upon all the preset box opening code are invalid.

It should be noted that, the box opening code management circuit does not have to be integrated in the processor; it could be arranged in the mailbox as a separate logic module.

It's obvious to the skilled persons in the art that, the above mentioned electric components can be integrated into one chip, and this chip could be arranged in the mailbox in an invisible manner when viewing from outside.

It should be noted that, the storage and/or the processor could be arranged either in the mailbox, or in the remote management terminal. The storage in the remote management terminal could be configured to have much larger storage capacity, and the processor in the remote management terminal could be configured to have much more powerful processing ability. In the case that the communication rate is high enough, using the storage and/or processor in the remote management terminal brings better efficiency. In some preferable embodiments, a local storage and/or processor could be provided in the mailbox, while a remote storage and/or processor could also be provided in the remote management terminal; the tasks will be distributed among the local and remote storages and/or processors according to its complexity for obtaining a best effect. In the case there are both local and remote storages, the data will be synchronized in real time or at an appropriate interval.

Figure 7:
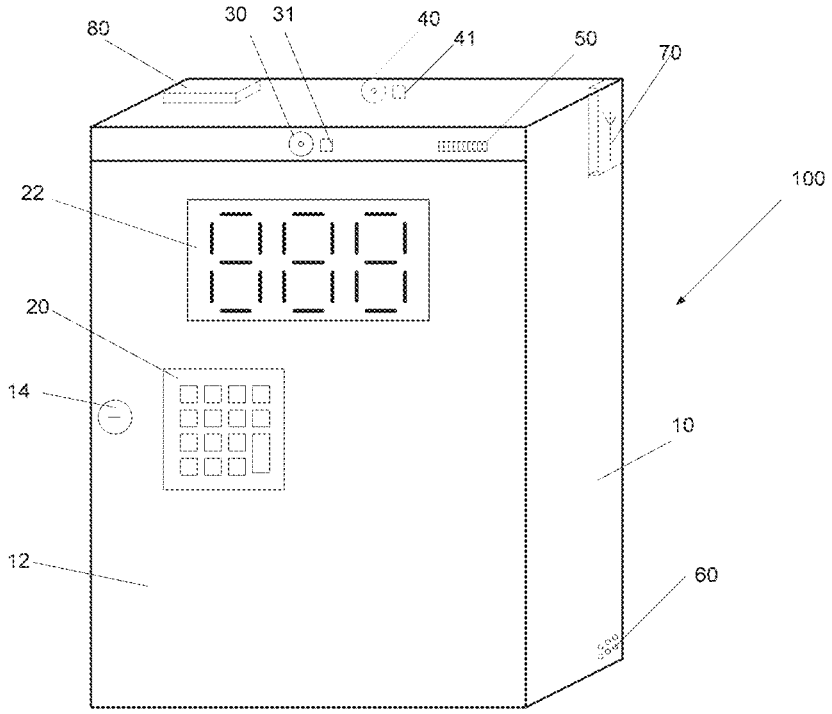
Figure 7A:
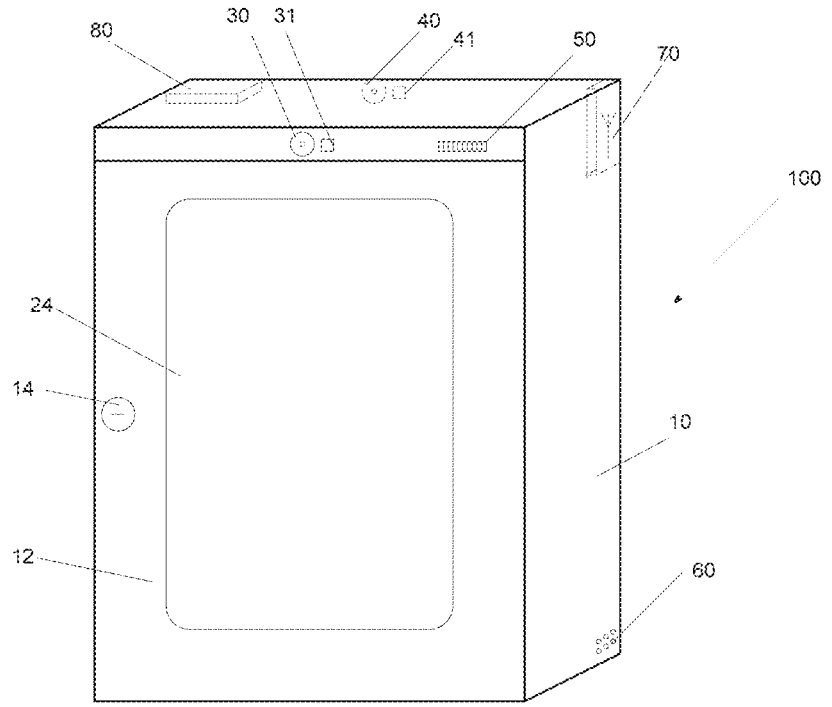

FIG. 7 illustratively shows one preferable embodiment of the smart mailbox according to this invention. In this embodiment, the mailbox comprises all the above features described separately, wherein the mailbox 100 is provided with a keyboard 20 and a LED display 22. FIG. 7*a* illustratively shows another preferable embodiment of the smart mailbox according to this invention, wherein the mailbox 100 is provided with a touch panel 24 to replace the keyboard and the LED display.

It should be noted that, the above described embodiments are only illustrative, but not limitative. The above described features could be implemented separately or in combination in various embodiments, as long as falling into the scope of this invention.

Figure 8:
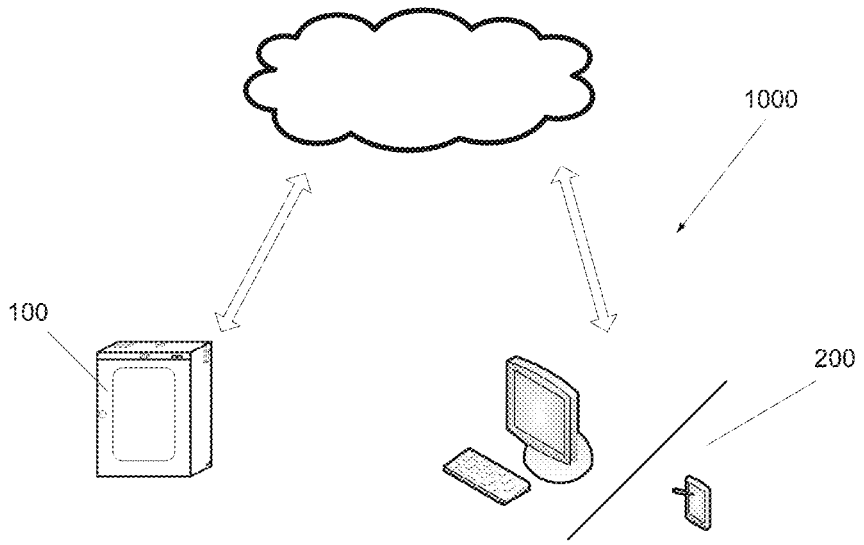

FIG. 8 illustratively shows one embodiment of the smart mailbox system according to this invention. The system 1000 comprises a smart mailbox 100 and a remote management terminal 200. The smart mailbox can be as any of the above described embodiments. The remote management terminal could be an immobile terminal, such as a large server, or a mobile terminal, like a handset device, e.g. a cell phone. The remote management terminal could be used to issue instructions to the mailbox. In a preferable embodiment, the remote management terminal could comprise an immobile terminal and a mobile terminal at the same time; the immobile terminal is mainly used storing the data and processing, while the mobile one is mainly used to issue instructions by mailbox administrator directly.

Figure 9:
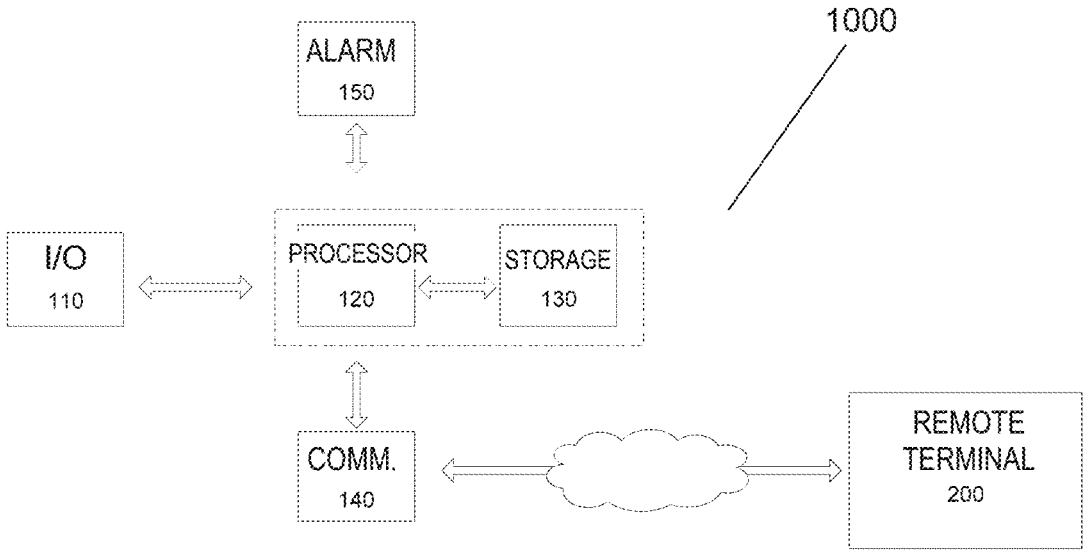

FIG. 9 illustratively shows one embodiment of circuit logic of the smart mailbox system according to this invention. As shown in the figure, the system 1000 could comprise an I/O module 110, a processing module 120, a storage module 130, a communication module 140, and also an alarm module 150. The 1/O module 110 could comprise e.g. the above mentioned keyboard, touch panel, code reader, camera for input, and the display and loudspeaker for output. The processing module 120 and the storage module 130 is squared with dashed lines because they could be arranged either in the local mailbox or in the remote management terminal 200.

Figure 10:
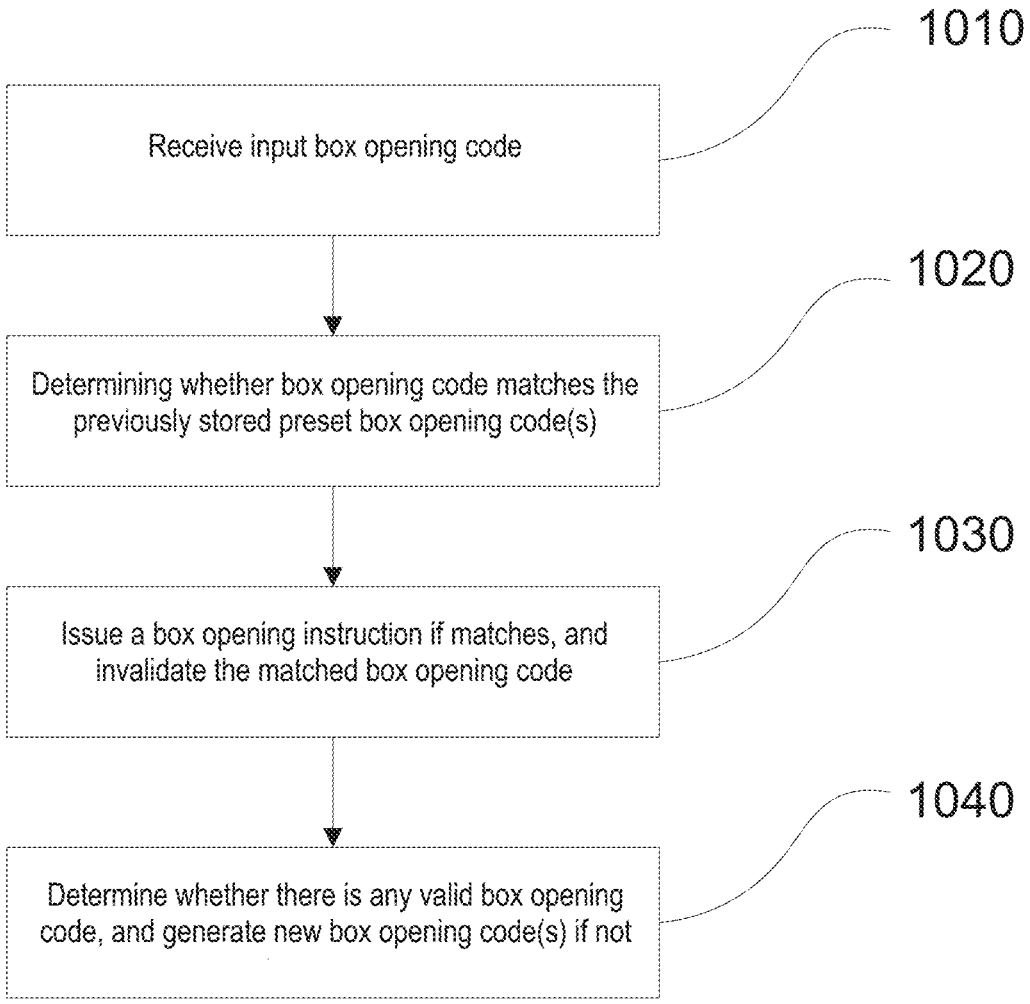
FIG. 10 shows the flow chart of the controlling method according to one embodiment of this invention.

FIG. 10 shows an embodiment of the flow chart of the controlling method according to this invention.

In this embodiment, firstly, in step 1010, the input box opening code is received. For example, the input of the box opening code could be implemented by means of a keyboard or touch panel. In some embodiments, it could also be acoustically implemented by means of a microphone.

Then, in step 1020, the processor determine whether the input box opening code matches the previously stored preset box opening code. For example, the preset box opening code is "1234", and the input box opening code is also "1234"; they equal to each other so they match. In another example, the preset box opening code is "1234", the input box opening code is "2468"; they have a certain algorithm relationship and this could also be regarded as a "match". It is to be understood, such algorithm relationship should be set in advance, and it is preferably a one-on-one single mapping.

If the input box opening code matches the box opening code, then in step 1030 the processor issues the box opening instruction, so as to unlock the door; and the processor invalidates the matched preset box opening code. For example, the preset box opening code "1234" matches the input box opening code "1234", then the preset box opening code "1234" is invalidated. In one example, the preset box opening code could be invalidated at the same time the processor issues the box opening instruction. In another example, it could be invalidated after the box is opened. In yet another example, it could also be invalidated in a delayed time, for example, when the mailbox is re-closed.

At last, in step 1040, it determines whether there is any preset valid box opening code, and generates new box opening code(s) if not. In one example, the processor inquiries whether there is any valid preset box opening code in the storage every time it invalidates one box opening code. In another example, when all the preset box opening code are invalid it triggers the generation, e.g. the parameter N representing the number of the valid preset box opening code is set to 0, and generates new box opening code(s).

It should be noted that, although in above embodiments the controlling method is described with these steps, they are not the minimum unit for implementing the method, i.e. these steps could also further divided. For example, step 1030 could be divided into two sub-steps of issuing the box opening instruction and invalidating the matched preset box opening code. The skilled persons in the art will understand how to adjust the action and order of every step on the scope of this invention.

The controlling method according to this invention further comprises some optional steps. As to these controlling methods comprising the optional steps, although they are not shown in a flow chart, they can be understood by the hereinafter description.

In one embodiment, it receives the mail ID code, such as a barcode or matrix code, scanned by an ID code scanner. When the scanned ID code matches the preset ID code previously stored in the storage, and the input box opening code matches the preset box opening code, the processor issues the box opening instruction. For example, the preset ID codes previously stored in the storage are barcodes pattern AAA and BBB, the preset box opening codes are 1234 and 5678; the scanned barcode pattern is AAA, and the input box opening code is 1234, then the processor issues the box opening instruction. If the scanned barcode pattern is CCC, although the input box opening code is 1234, the processor does not issue any box opening instruction.

In another embodiment, only when the matched box opening code satisfies the mapping relationship with the matched ID code, it issues the box opening instruction. For example, the preset ID code previously stored in the storage are barcode patterns AAA and BBB, the preset box opening codes are 1234 and 5678, and it is preset that the barcode pattern AAA maps with the box opening code 1234, and the barcode pattern BBB maps with the box opening code 5678. Then, if the scanned barcode pattern is AAA, and the input box opening code is 1234, the processor issues the box opening instruction. If the scanned barcode pattern is BBB, while the input box opening code is 1234, the processor does not issue any box opening instruction.

In one preferable embodiment, only after the scanned ID code matches the preset ID code, the box opening code input device is activated; alternatively, only after the input box opening code matches the preset box opening code, is the ID code scanner activated. For example, the preset ID code previously stored in the storage are barcode patterns AAA and BBB, the preset box opening code are 1234 and 5678. When the mailbox is awaken, the ID code scanner could be firstly activated, and tips are given e.g. from the display that it requires to scan the ID code; after scanning the pattern AAA as the ID code, is the box opening code input device activated, and tips are given e.g. from the display that it requires to input the box opening code. Alternatively, when the mailbox is awaken, the box opening code input device is firstly activated, and tips are given e.g. from the display that it requires to input the box opening code; then, after receiving 1234 as the input box opening code, is the ID code scanner activated, and tips are given e.g. from the display that it requires to scan the ID code.

In one embodiment, in the mailbox it is further provided an outer camera, e.g. a front camera, for at least monitoring the circumstance around the box body before opening the box. In one more preferable embodiment, the processor analyzes the record of the outer camera, after confirming there is nothing unusual, for example, the processor can clearly recognize the profile characteristics of the mailbox user, especially his/her facial characteristics, it issues the box opening instruction. In one example, the mailbox could be provided with several outer camera, for example one front camera and two side cameras in the left and the right, to grantee a complete cover to the circumstance around the box body. In another example, after the scanned ID code matches the preset ID code and the input box opening code matches the preset box opening code, it does not issues the box opening instruction immediately, but waits until confirming the facial characteristics of the mailbox user is clear, and then issues the box opening instruction. In another example, the record of the outer camera is stored in the storage, for subsequent queries.

In one embodiment, in the mailbox it is further provided e.g. an inner camera, for at least from the box opening to the box closure monitoring the circumstance inside the box body. In one example, due to the internal construction of the mailbox, one camera may not be sufficient to cover inside the mailbox, then there could be provided with several cameras. In one example, only after the processor issues the box opening instruction, the inner camera is activated. In one example, after the door is closed, the processor gives out an confirmation message, which could be a message representing the box is closed, or other message representing whether the receipt is safe of whether there is an abnormal operation. For example, the processor analyzes the record of the inner camera, confirms the safe receipt conditions are satisfied, like the outer packing of the mail is not broken, and then gives out the confirmation message. In another example, the record of the inner camera is stored in the storage, for subsequent queries.

As described above, in one preferable embodiment, the mailbox is provided with an outer display, for giving operating tips to the operator before opening the mailbox. In another preferable embodiment, in the mailbox it is provided an inner display, for giving operating tips to the operator after opening the mailbox. In one example, the inner display is positioned at the back of the mailbox door, so that the user could see it after opening the door. In one example, only after the processor issues the box opening instruction, is the inner display activated.

In one embodiment, on the mailbox it is provided an inner power source, the battery status of the inner power source is monitored. In another preferable embodiment, on the mailbox it is provided an external power supply, and the on/off status of the external power supply is monitored. In some other preferable embodiments, on the mailbox it is further provided various sensors, to detect the various parameters of the mailbox, like a vibration sensor for detecting the vibration of box body, a gravimetric sensor for detecting the weight of the items inside the mailbox, and an altimetric sensor for detecting the height of the mailbox.

In one embodiment, in the mailbox it is further provided an alarm device, for alarming in an abnormal case. Such an abnormal case could be such as the abnormal vibration of the box body which is caused by an abnormal (usually violent) box opening or detachment, an abnormal height variation of the mailbox which is usually caused due to the mailbox taken away, and an abnormal weight variation of the items inside the box which is usually caused by an unauthorized taken away of the items or a non-equivalence of the actual weight variation and the expected variation. The abnormal case could also be that the power supply is turned off or will be turned off, like a low battery or an unauthorized taken away of the inner power source, or a cut off of the external power supply. In some more preferable embodiments, several features are combined for determining whether there is an abnormal case, such as the vibration sensor input and the outer camera input are combined to be determined whether there is a violent box opening. In another example, the gravimetric sensor input and the inner camera input are combined to determine whether there is an unauthorized taken out of the items. In some more preferable embodiments, it is determined as an abnormal case only when some status are maintained for a certain period, for example, if the data detected by the gravimetric sensor (weight of the items inside the box) is reduced, but after e.g. 3 seconds it recovers, this might be caused by a position adjustment of the items; in such a case, it could be configured that it is determined as an abnormal case when the weight is reduced but not recovers for e.g. 5 seconds.

In one example, the alarm information is also sent to the remote management terminal, e.g. the server, or to the mailbox administrator's handset. In another example, the alarm device can be activated or turned off by the mailbox administrator, e.g. by issuing remote instructions. In one example, the alarming causes e.g. a shrill ring or a siren. In another example, the alarming is to send a warning message to the mailbox administrator; in such a case, it should be understood that the warning message could be generated by the processor other than the alarm.

In one preferable embodiment, the alarming information is combined with other features of the mailbox for analysis, such as it gives out confirmation message only under the situation there is no alarm triggered. In another example, when an alarm is triggered, especially by the vibration sensor or the altimetric sensor, the outer camera is immediately activated (if it is in sleeping mode).

In one embodiment, before inputting the box opening code, the user should choose his/her user group such as sender, recipient, courier or administrator. It could also be configured that the user group is in a mapping relationship with the preset box opening code, for example, the numbers or the first number of the box opening code could be used to represent the user group. Then, when the user input the box opening code, his/her user group will be known.

By means of the smart mailbox system of this invention, an automatically mail receiving could be realized.

FIG. 11 shows the method of automatically receiving mail according to one embodiment of this invention.

The recipient is usually the mailbox administrator. In step 1110, when or before the sender/courier arrives at the designated address, he/she contacts the recipient, and gets the mailbox opening code from the recipient. Then, in step 1120, the sender/courier input the box opening code in front of the mailbox and thus to unlock and open it. And then, in step 1130, the sender/courier puts the mail into the mailbox and closes it (it automatically locks). Then, because the mail is put into the mailbox which is under the control of the recipient, it could be deemed that a safe receipt is done.

After the mailbox is closed, in an optional step 1140, the old box opening code is invalidated, while new box opening code is generated. The recipient then could get the new box opening code from the system, use it to open the mailbox, and take the mail out. Step 1140 is squared in dashed lines because it is regarded as a step after the safe receipt is done.

When the mailbox is closed again by the recipient, the "new" box opening code is invalidated, and a newer box opening code is generated.

It is to be understood, because the recipient is also the mailbox administrator, he/she can use an administrator code instead of the box opening code to open the mailbox. In such a case because the "new" box opening code is not used, it is still valid then the mailbox is closed. However, it could also be configured that when the recipient closes the mailbox, the "new" box opening code is nevertheless invalidated, and a "newer" box opening code is generated. The advantage of this approach is that the mailbox administrator can reset the box opening code easily, and there is no need for him to cost time to look for the valid box opening code after a long time non-use. It is to be understood, the reset of the box opening code could also be configured that it is carried out according to the instruction of the mailbox administrator.

In some embodiments, the recipient has to receive more than one mail before taking them out, then when the next sender/courier sends the mail, he/she will also ask for the box opening code from the recipient. After the sender/courier finishes his/her sending (open the mailbox, put the mail into and then close the mailbox), the box opening code he/she used is invalidated, and a "newer" box opening code is generated. Alternatively, it could also be configured that the recipient presets several box opening codes which maps with the mails, and send them to each sender/courier. Every sender/courier uses the box opening code he/she received to open the box, and when he/she closes the mailbox, the box opening code he/she used is invalidated. When the last preset box opening code is invalidated, new box opening code(s) are generated to the recipient.

In some embodiments, the recipient is not the mailbox administrator. Then the recipient needs to obtain the box opening code from the mailbox administrator, and sends it to the mail sender/courier or leave it for himself/herself.

In another complicated case to automatically receive the mail by using the system of this invention (assuming the recipient is the mailbox administrator), the sender/courier has to not only input the box opening code in front of the mailbox, and also use the code reader on the mailbox to scan the matrix code (or barcode) of the mail; only when the input code and the read matrix code (or barcode) are both correct, the mailbox can be unlocked to open. The matrix code (or barcode) of the mail could be obtained from the sender/courier (or courier company) and stored in the system.

In a more complicated case that, for example, the recipient has to receive more than one mail in one day, he/she will preset several box opening codes which maps with the mails, and send them to each sender/courier. Meanwhile, the recipient also get the identification code (such as a barcode or matrix code) of each mails from the sender/courier (or courier company). The recipient previously stores these identification code, and maps them with the several box opening code. In such a case, when the sender/courier sends the mail, he/she shall input his/her obtained box opening code, and use the code reader to scan the identification code of the mail; only when the input code and the read code are both correct, and they map to each other, the mailbox can be unlocked to open. After the sender/courier closes the mailbox, the input code and read code are invalidated. When the last pair of the preset box opening code and identification code are invalidated, new box opening code(s) are generated to the recipient.

FIG. 11*a* shows the method of automatically receiving mail according to one preferable embodiment of this invention. In this embodiment, for the purpose of a simple narrative, the recipient is the mailbox administrator.

In step 1110*a*, the sender/courier obtains from the recipient the box opening code.

In step 1120*a*, when the sender/courier stands in front of the mailbox and is ready to put the mail into the mailbox, he/she firstly touches any key of the keyboard (or any part of the touch panel), to activate the mailbox from sleeping mode.

Then, in step 1130*a*, according to the tips on the display of the mailbox and the corresponding acoustic tips, he/she uses the code reader on the mailbox to scan the identification code of the mail, and inputs the box opening code via the keyboard (or touch panel); meanwhile, the front camera of the mailbox takes photos in front of the box; only when the processor confirms the mail identification code and the box opening code are both correct, and the photos taken by the front camera is not abnormal (for example, the facial characteristics of the sender/courier is clear), the mailbox is unlocked, so that the sender/courier can open the mailbox.

In step 1140*a*, after the sender/courier opens the mailbox, he/she holds the mail under the inner camera for a few seconds, so that the inner camera can take photos of the mail outer packing; the processor analyzes these photos, confirms the mail satisfy the safe receipt standard (for example, the outer packing is in good condition), and then gives out the tips to the sender/courier.

In step 1150*a*, the sender/courier puts the mail into the mailbox, and meanwhile the gravimetric sensor in the bottom of the mailbox detects the weight variation in the mailbox. If it is not expected, it alarms. For example, if the expected mail is about 500 g, while the detected weight is 400 g or 600 g, then it means the mail might be not the expected one, then a warning is sent to the recipient, and a message could also be send to the sender whether there is a mistake when packing.

In step 1160*a*, when the sender/courier closes the door, he/she can leave. The door is automatically lock when closed. If no alarm is triggered, the processor gives the recipient a message confirming safe receipt.

In an optional step 1170*a*, the processor issues instructions to invalidate the used box opening code, and generates new box opening code(s). The step 1170*a* is squared in dashed lines because it could be regarded as one step after the safe receipt is done.

When the recipient fetches the mail, he/she obtains from the system the box opening code or uses the administrator code to open the mailbox, checks under the camera whether the mail satisfies the safe receipt condition. If so, an acknowledgment of the receipt is sent to the sender (or courier company). In other cases, it could also be configured that the system sends the acknowledgment of the receipt to the sender at the same time it sends the safe receipt message to the recipient. Alternatively, it is configured that, after the sender/courier finishes the sending but before the recipient takes out the mail, the photos taken by the camera are sent to the recipient, the recipient make a judgment based on these photos and then send the acknowledgment of the receipt to the sender.

In some optional embodiments, when the sender uses the code reader on the mailbox to scan the barcode or matrix code of the mail, he/she shall input the courier number of the mail as an alternative or additional input; Furthermore, he/she might have to input the name of his/her company and his/her employee number, and so on.

By using this invention an automatically sending mail could also be realized.

FIG. 12 shows the method of automatically sending a mail according to one embodiment of this invention. For the purpose of a simple narrative, in this embodiment the sender is the mailbox administrator, so the sender could obtain the box opening code directly.

In step 1210, the sender puts the mail to be sent into the mailbox, and then sends the box opening code to the designated recipient/courier. In step 1220, the recipient/courier inputs the box opening code in front of the mailbox, and unlock it. In step 1230, the recipient/courier takes the mail out, and close the door. Then, it could be regarded that a safe sending is done, because the mail is transferred to the recipient/courier.

When the recipient/courier closes the mailbox, in an optional step 1240, the box opening code is invalidated, and new box opening code(s) is generated. Step 1240 is squared in dashed lines because it could be regarded as a step after the safe sending is done.

It should be noted that, in some embodiments, the sender is not the mailbox administrator. Then, the sender could obtain the box opening code from the mailbox administrator, and then tell the recipient/courier or leave it for his/her own use.

FIG. 12*a* shows the method of automatically sending a mail according to one preferable embodiment of this invention. For the purpose of a simple narrative, in this embodiment the sender is the mailbox administrator.

In step 1210*a*, the sender puts the mail to be sent into the mailbox, and sends the preset box opening code to the designated recipient/courier.

In step 1220*a*, when the recipient/courier stands in front of the mailbox and is ready to take the mail out, he/she firstly touches any key of the keyboard (or any part of the touch panel), and activates the mailbox from sleeping mode.

Then, in step 1230*a*, he/she inputs his/her company name and employee number according to the tips on the display on the mailbox, and inputs the box opening code; meanwhile, the front camera of the mailbox takes photos in front of the box; only when the processor confirms the company name, the employee number and the box opening code are all correct, and the photos taken by the front camera is not abnormal (for example, the facial characteristics of the sender/courier is clear), the mailbox door is unlocked, so that the recipient/courier can open the mailbox.

In step 1240*a*, the recipient/courier opens the mailbox, according to the tips on the inner display at the back side of the mailbox door and the corresponding acoustic tips, he/she takes the mail and checks it under the inner camera whether a fetching condition is satisfied (for example, the outer packing is in good condition).

In step 1250*a*, after confirming the mail satisfies the fetching condition, the recipient/courier takes the mail, and closes the mailbox.

In step 1260*a*, the mailbox is closed and then automatically locked, then the processor sends a message to the sender that the recipient/courier has taken the mail; it is to be understood, the recipient/courier could send a message to the sender that he/she has taken the mail.

Further, in an optional step 1270*a*, the processor issues an instruction to invalidate the used preset box opening code, and generates new box opening code(s). Step 1270*a* is squared in dashed lines because it could be regarded as a step after the safe sending is done.

It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

The invention claimed is:

1. A system comprising a mailbox, a local or remote storage device, and a remote management terminal, wherein the mailbox comprises:

a box body having a door with a lock, a box opening code input device configured to receive a box opening code for unlocking the door, an inner power source inside an inner power source box having a cover with an electronic lock, wherein the electronic lock is configured to be unlocked by receiving the box opening code via the box opening code input device, and a communication unit configured to communicate with the local or remote storage device and the remote management terminal; and wherein the local or remote storage device is configured to store one or more preset box opening codes, and wherein the remote management terminal comprises:

a processor configured to:

determine that the received box opening code matches one of the one or more preset box opening codes, issue a box opening instruction in response to determining that the received box opening code matches one of the one or more preset box opening codes, invalidate the matched box opening code upon the door being opened, generate one or more new box opening codes upon the one or more preset box opening codes being invalidated, and store the one or more new box opening codes in the local or remote storage device.

2. The system of claim 1, further comprising:

at least one inner camera configured to monitor inside of the box body when the door is unlocked; and at least one outer camera configured to monitor proximity of the box body when the door is locked.

3. The system of claim 2, wherein the processor is further configured to analyze information recorded by the at least one outer camera, and activate the box opening code input device to allow the box opening code input device to receive the box opening code based on the analyzed information.

4. The system of claim 2, wherein the processor is further configured to analyze information recorded by the at least one outer camera, and in response to obtaining a face characteristic of a user of the mailbox based on the analyzed information, issue the box opening instruction.

5. The system of claim 2, wherein the processor is further configured to analyze information recorded by the at least one inner camera of the mailbox, and issue a mail receipt confirmation in response to confirming an outer packing of a mail in the mailbox is in a good condition.

6. The system of claim 1, further comprising:

a first display on a front side of the box body configured to provide an operating tip to a user of the mailbox; and a second display on a backside of the door configured to provide an operating tip to a user of the mailbox when the door is opened.

7. The system of claim 1, further comprising an alarm device configured to provide an alarm in response to an abnormal situation, wherein information relating to the alarm is sent to the remote management terminal via the communication unit.

8. The system of claim 1, further comprising at least one of:

a vibration sensor configured to detect vibration of the mailbox;

a gravimetric sensor configured to measure weight of any items inside the mailbox; and an altimetric sensor configured to determine a height of the mailbox.

9. The system of claim 8, further comprising an alarm device configured to generate an alarm in response to at least one of:

the vibration sensor detecting an abnormal box opening event or an abnormal box detachment event, the gravimetric sensor detecting an abnormal change of the weight of the items inside the mailbox, and the altimetric sensor detecting an abnormal variation of the height of the mailbox.

10. The system of claim 1, further comprising an alarm device configured to generate an alarm in response to the inner power source being removed.

11. The system of claim 1, further comprising an external power supply, wherein an on/off status of the external power supply is monitored.

12. The system of claim 11, further comprising an alarm device configured to generate an alarm in response to the external power supply being cut off.

13. The system of claim 1, further comprising an ID code scanner configured to scan an ID code associated with a user of the mailbox, wherein the local or remote storage device is further configured to store one or more preset ID codes, and in response to the scanned ID code matching one of the one or more preset ID codes and the received box opening code matching one of the one or more preset box opening codes, issue the box opening instruction.

14. The system of claim 13, wherein the one or more preset ID codes map to the one or more preset box opening codes; and the processor issues the box opening instruction in response to the matched preset box opening code mapping to the matched preset ID code.

15. The system of claim 1, wherein the box opening code input device is further configured to determine a user group; and the one or more preset box opening codes map to the determined user groups.

16. The system of claim 1, wherein the processor is further configured to generate one or more new box opening codes after an administrator opens the mailbox by using an administrator code.

17. The system of claim 1, wherein the processor is further configured to receive ID information of a user of the mailbox before opening the mailbox, and issue the box opening instruction in response to verifying the ID information.

* * * * *